US005966501A

United States Patent [19]

Miller et al.

[11] Patent Number: 5,966,501

[45] Date of Patent: Oct. 12, 1999

[54] METHOD FOR CONTROLLING THE VISCOSITY OF A FLUID IN A DEFINED VOLUME

[75] Inventors: Charles G. Miller, Branford, Conn.; John A. Rolls, Armonk, N.Y.; Otis H. Hastings, Mahwah, N.J.

[73] Assignee: Themion Systems International, Stratford, Conn.

[21] Appl. No.: 08/633,966

[22] Filed: Apr. 19, 1996

[51] Int. Cl.[6] ..... F24H 1/18; F27D 11/00

[52] U.S. Cl. ..... 392/458; 219/385

[58] Field of Search ..... 392/458–459, 392/444, 480; 219/213, 543, 544, 528, 529, 548, 549, 426, 427, 420–421; 338/255–257, 262, 292, 308

[56] References Cited

U.S. PATENT DOCUMENTS

| | | | |
|---|---|---|---|
| 890,857 | 6/1908 | Hadaway, Jr. | 219/430 |
| 968,971 | 8/1910 | Peck | 219/386 |
| 1,151,189 | 8/1915 | Kercher | 219/439 |
| 2,006,059 | 6/1935 | Rudorff | 219/439 |
| 2,079,611 | 5/1937 | Harvey | 219/202 |
| 2,478,499 | 8/1949 | Osterheld | 392/451 |
| 2,500,241 | 3/1950 | Brown | 219/438 |
| 2,607,879 | 8/1952 | Workman | 392/458 |
| 2,700,097 | 1/1955 | Morey | 219/433 |
| 2,737,571 | 3/1956 | Eisler | 392/458 |
| 2,748,252 | 5/1956 | Williams et al. | 392/480 |
| 2,805,313 | 9/1957 | Lumb, Jr. | 219/543 |
| 3,105,136 | 9/1963 | Ashenfarb | 392/480 |
| 3,108,170 | 10/1963 | Murphy | 392/459 |
| 3,178,913 | 4/1965 | Olson | 392/485 |
| 3,206,125 | 9/1965 | Farrell | 392/458 |
| 3,505,498 | 4/1970 | Shevlin | 392/458 |
| 3,609,297 | 9/1971 | Christopoulos | 219/439 |
| 3,657,516 | 4/1972 | Fujihara . | |
| 3,859,504 | 1/1975 | Motokawa et al. . | |
| 4,039,720 | 8/1977 | Cherenko et al. . | |
| 4,110,151 | 8/1978 | Morse . | |
| 4,245,149 | 1/1981 | Fairlie . | |
| 4,250,397 | 2/1981 | Grey et al. . | |
| 4,282,049 | 8/1981 | Morse . | |
| 4,534,886 | 8/1985 | Kraus et al. . | |
| 4,734,231 | 3/1988 | Morita et al. . | |
| 4,737,618 | 4/1988 | Barbier et al. . | |
| 4,920,868 | 5/1990 | Gehrmann | 99/279 |
| 4,935,602 | 6/1990 | Bravo | 392/458 |
| 4,942,078 | 7/1990 | Newman et al. . | |
| 4,972,197 | 11/1990 | McCauley et al. | 343/704 |
| 5,027,425 | 6/1991 | Slomka | 392/480 |
| 5,250,228 | 10/1993 | Bairgrie et al. . | |
| 5,344,696 | 9/1994 | Hastings et al. . | |
| 5,361,183 | 11/1994 | Wiese . | |
| 5,557,704 | 9/1996 | Dennis et al. | 392/480 |

FOREIGN PATENT DOCUMENTS

| | | |
|---|---|---|
| 496388 | 7/1992 | European Pat. Off. . |
| 2628506 | 9/1989 | France . |
| 4221455 | 1/1994 | Germany . |
| 8809596 | 1/1988 | WIPO . |
| 9515670 | 6/1995 | WIPO . |

*Primary Examiner*—Teresa Walberg
*Assistant Examiner*—Daniel Robinson
*Attorney, Agent, or Firm*—White & Case LLP

[57] ABSTRACT

A method is provided for heating the interior surface of a defined volume, such as the interior of a pipe or tank, to control the viscosity of a liquid contained within that volume. In the method, a laminated composite heater element, impermeable to water, is disposed on the surface of the receptacle, and is energized at prescribed intervals and temperatures effective to heat the interior surface of the volume.

5 Claims, 3 Drawing Sheets

METHOD FOR CONTROLLING THE VISCOSITY OF A FLUID IN A DEFINED VOLUME

BACKGROUND OF THE INVENTION

1. Field of the Invention

The present invention relates generally to methods of controlling the viscosity of fluids. Specifically, the invention relates to a method of controlling the viscosity of a fluid in a defined volume by heating the inner surfaces of the volume through the use of a heater element such as a heater element laminated composite in the form of a thin, laminated material applied to the surface.

2. Description of the Prior Art

It is well known that the viscosity of a liquid is a function of the liquid temperature. It follows that heating the inner surface of a volume containing a liquid, such as the interior of a pipe or tank, will alter the viscosity of the liquid.

A variety of methods for heating surfaces through the use of heater elements exist in the prior art. U.S. Pat. No. 4,534,886, to Kraus et al., discloses an electrically conductive web composed of a non-woven sheet of conductive fibers and non-conductive fibers. The sheet is saturated with a dispersion containing conductive particles and dried. The Kraus et al. heater element is primarily used in heating pads.

International Application No. PCT/US94/13504 (Publication No. WO95/15670), discloses an electrically conductive composite heating assembly that has an electrically conductive non-woven fiber layer laminated between layers of fiberglass and other dielectric material. The assembly further has an abrasion resistant outer layer. The heater element is used on aerospace structures as an ice protection system to withstand repeated mechanical stress and thermal cycles in extremely harsh aerospace environments.

U.S. Pat. No. 5,344,696 to Hastings et al. discloses an integrally bonded laminate which is used to thermally control a surface or portion of a surface of an aircraft to which the laminate is bonded.

None of the prior art heater elements, however, have been successfully applied to the surface of a defined volume for the purpose of controlling the viscosity of the fluid contained therein.

SUMMARY OF THE INVENTION

The present invention comprises a method for heating the interior surface of a defined volume, such as the interior of a pipe or tank, to control the viscosity of a liquid contained within that volume. The method comprises providing a heater element; disposing the heater element on the interior or exterior surface of the defined volume, and energizing the heater element at prescribed intervals and to prescribed temperatures which are effective to heat the interior surface and alter the viscosity of the liquid within the volume.

DETAILED DESCRIPTION OF THE PREFERRED EMBODIMENT

In the preferred embodiment, the method for heating the interior surface of a defined volume to control the viscosity of a liquid contained therein comprises, disposing a laminated composite heater element, impermeable to water, on a surface of the defined volume, and energizing the heater element at prescribed intervals and temperatures which are effective to heat the interior surface of the defined volume. The heated surface consequently heats the liquid within the volume, thereby decreasing the viscosity of the liquid within the volume.

The heater element of the present invention is a laminated composite, impermeable to water, and is of the type disclosed in U.S. Pat. No. 5,344,696 (Hastings et al.), which is incorporated herein by reference. As disclosed in the Hastings et al. patent, the heater element comprises a durable outer ply, which is resistant to abrasion and impermeable to water, bonded to and through a conductive layer of fibers, and an integrally enveloping adhesive, which is adhered to the surface of the defined volume. The conductive layer is connected to a source of electrical energy, and control means are adapted to control the temperature of the surface of the defined volume. This laminated composite structure is considered preferable; however, it is contemplated that other structures may be used. For example, the heater element need not be a laminated composite structure. Rather, the heater element may comprise merely a layer of conductive fibers embedded within the volume. This structure of the heater element is particularly useful if the material into which the heater element is embedded has dielectric properties that will evenly distribute the heat generated by the element.

In one embodiment of the invention, the preferred heater element is manufactured under the trademark Thermion™ by Aerospace Safety Technologies, Inc. Thermion™ is light, flexible and may be translucent. The material is a laminate which provides even heating and can be conformed to surfaces having a variety of different contours and shapes. Operational power can be derived from low or high voltage AC or DC power supplies.

Figure 1:
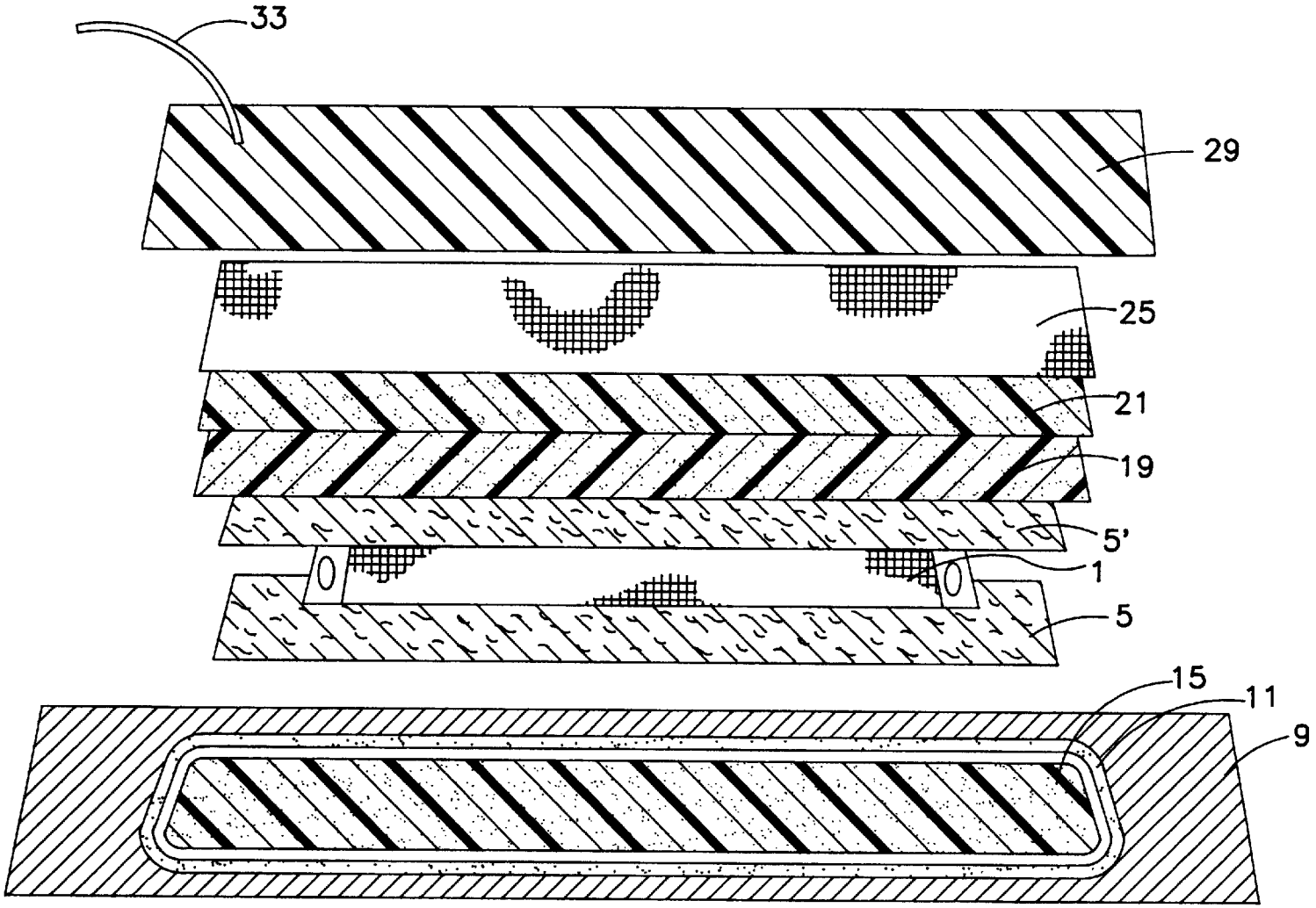
FIG. 1 depicts the construction of a composite heater element of the invention in a mold.

A first variation in the method involves installing in the surface of the defined volume a pre-made panel, usually configured on a mold table for easy transfer to the final surface. As shown in FIG. 1, the pre-made panel comprises a fiberglass resin encapsulated heater element 1, further encapsulated in two fiberglass/resin cloths 5 and 5'. The pre-made panel also contains electrical leads (not shown), which extend outside of the panel, and are connected to the power supply (not shown). The laminate optionally can be constructed with one or more layers of the fiberglass resin encapsulated heater element 1. A multiple-layered heater element can provide greater control over the heat output from the assembly.

FIG. 1 shows how a single layer pre-made panel is formed on a transfer table. The fiberglass resin encapsulated heater element 1 is placed on top of a mold table surface 9. A mold release wax 15 is disposed between the encapsulated heater element 1 and the table surface 9. A peel ply 19 is placed above the encapsulated heater element 1. A release ply 21 is disposed above the peel ply 19 and a bleeder cloth 25 is disposed over the release ply 21. Finally, a vacuum bag 29 is disposed over the release ply 21. A seal tape 11 surrounding the layers on the mold is attached to the table top surface 9, and can adhere to the vacuum bag 29 to create a tight seal. A vacuum supply 33 is used to evacuate the air between the layered material in order to bring the layers into close opposition with each other and cure the resin, bonding the layers to create the laminate.

Figure 2A:
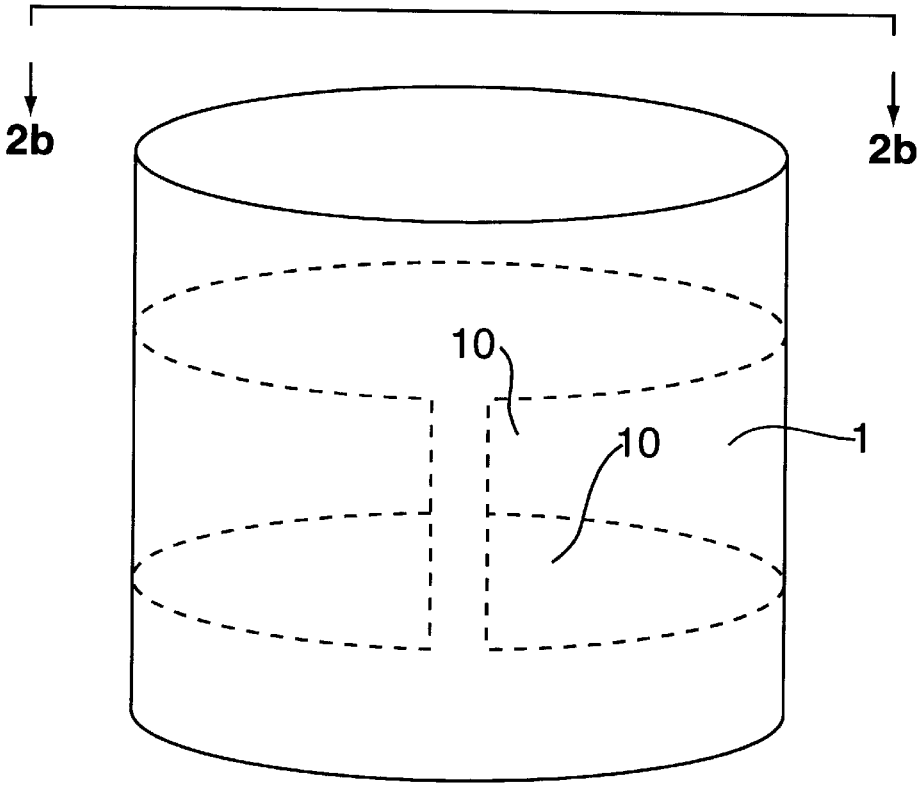
FIG. 2*a* is a schematic drawing of a defined volume or tank of the invention, wherein the laminated composite heater is disposed on the interior surface of the volume.
Figure 2B:
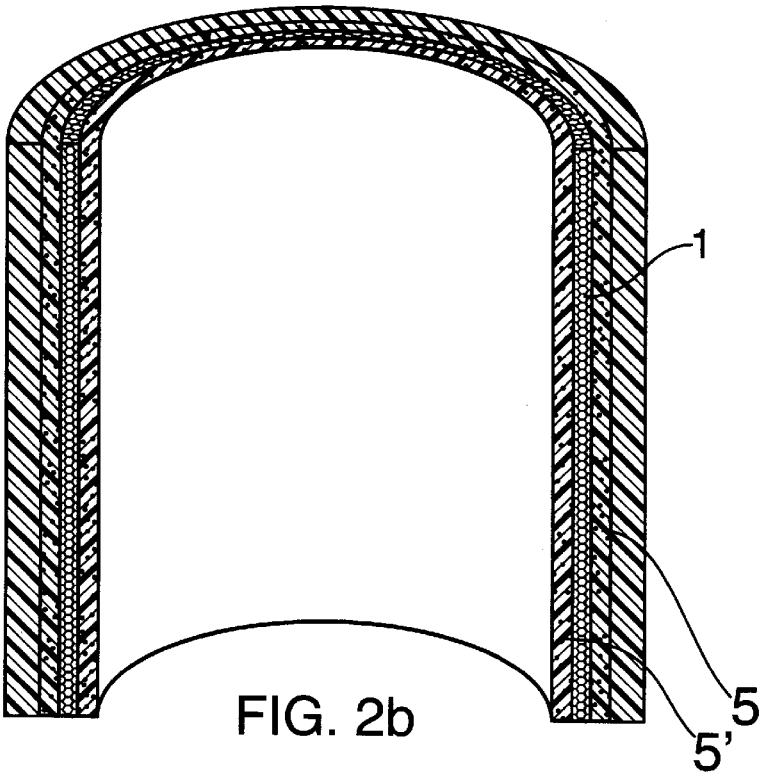
FIG. 2*b* is a longitudinal section of the tank.
Figure 3A:
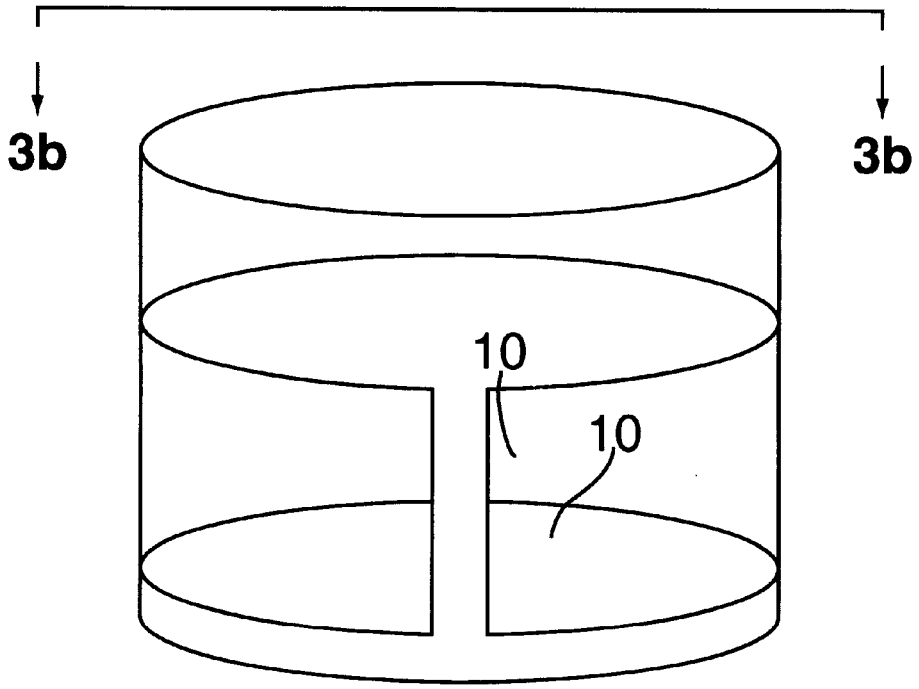
FIG. 3*a* is a schematic drawing of a defined volume of the invention, wherein the laminated composite heater is disposed on the exterior surface of the volume.
Figure 3B:
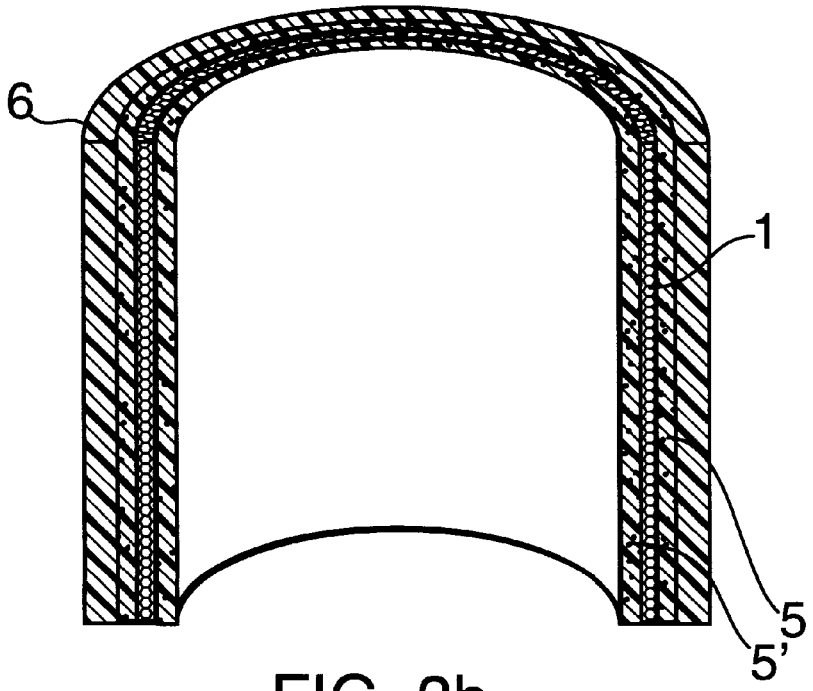
FIG. 3*b* is a longitudinal section of the tank.

The heater element is disposed on part or all of the interior or exterior surface of the defined volume. FIGS. 2*a* and 2*b* show a heated tank of the invention wherein the heater element 1 is disposed on the interior surface 5 of the tank. The heater element can be attached by means of a lead 10 to a power source. FIGS. 3*a* and 3*b* show a heated tank wherein the heater element 1 is laminated on the exterior surface 6 of the tank. The heater is then energized at prescribed intervals and to prescribed temperatures effective to heat the interior surface and alter the viscosity of the particular fluid within the volume. The location of the heater may vary according to the particular material and type of heating required.

The method used for installation of the heater will depend on the pipe or tank material and the bonding necessary to achieve the effect desired. In a preferred embodiment, heater elements in the form of panels are wrapped around pipes or tanks in accordance with the present invention, to control the temperature of fluid within the pipes or tanks. Because of the material's flexible nature, an infinite number of designs can be incorporated into the piping system. The material can be adapted to various curves and connections which are incident in piping, or tank systems.

In another embodiment, the heater element may comprise merely a layer of conductive fibers and may be directly embedded within the surface of the defined volume. However, the surface material must possess sufficient dielectric properties to evenly distribute the heat generated by the fibers to the surface of the material and to maintain that heat over an extended period of time. Thermoplastic materials possess dielectric properties and are examples of materials which are suitable for use in the invention.

Among the uses in the fluid environment are tank heating to control icing and thermal mixing of fluid agents. This heating process is not limited to industrial uses. The automotive, recreational vehicle, large truck, and heavy equipment industries can make use of this technology in oil/hydraulic heating.

What is claimed is:

1. A method for heating and controlling the viscosity of a liquid within a defined volume, comprising:

providing a pre-formed panel heater element to the surface of the defined volume, wherein said pre-formed panel heater element consists of an inner layer composed of a fabric of electrically conductive fibers encapsulated between two fiberglass/resin; two outer fiberglass/resin layers disposed on opposing surfaces of said inner layer and encapsulating said inner layer; and electrical leads connected to said conductive fibers and adapted to receive power from a power source;

disposing the pre-formed panel heater element at a predetermined depth from the surface of the defined volume; and energizing the conductive fibers of the pre-formed panel heater element to distribute heat evenly in the interior surface of the volume and alter the viscosity of a liquid within the volume.

2. The method of claim 1, wherein the pre-formed panel heater element is encapsulated in a laminated composite.

3. The method of claim 1, wherein the conductive fibers of the fabric layer are energized at prescribed intervals and temperatures effective to reduce the viscosity of the liquid within the volume.

4. The method of claim 1, wherein the defined volume is a tank.

5. The method of claim 1, wherein the defined volume is a pipe.

* * * * *